US012089723B2

(12) United States Patent
O'Brien

(10) Patent No.: US 12,089,723 B2
(45) Date of Patent: Sep. 17, 2024

(54) PERSONAL HYDRATION SYSTEM WITH COOLING OR WARMING CAPABILITY

(71) Applicant: Government of the United States, as represented by the Secretary of the Air Force, Wright-Patterson AFB, OH (US)

(72) Inventor: Justin O'Brien, Huber Heights, OH (US)

(73) Assignee: Government of the United States of America as Represented by the Secretary of the Air Force, Wright-Patterson AFB, OH (US)

( * ) Notice: Subject to any disclaimer, the term of this patent is extended or adjusted under 35 U.S.C. 154(b) by 0 days.

(21) Appl. No.: 18/212,262

(22) Filed: Jun. 21, 2023

(65) Prior Publication Data

US 2023/0346112 A1 Nov. 2, 2023

Related U.S. Application Data

(62) Division of application No. 17/232,183, filed on Apr. 16, 2021, now Pat. No. 11,717,074.

(60) Provisional application No. 63/049,729, filed on Jul. 9, 2020.

(51) Int. Cl.

| | |
|---|---|
| ***A45F 3/00*** | (2006.01) |
| ***A45F 3/20*** | (2006.01) |
| *A45F 3/16* | (2006.01) |

(52) U.S. Cl.

CPC ..... *A45F 3/20* (2013.01); *A45F 2003/166* (2013.01)

(58) Field of Classification Search

CPC ..... A45F 2003/163; A45F 2003/166; A45F 3/20; A45F 3/04; A45F 3/005; B05B 9/002; A41D 2400/46; A42B 3/048

USPC ..... 222/175; 224/148.2

See application file for complete search history.

(56) References Cited

U.S. PATENT DOCUMENTS

| | | | | |
|---|---|---|---|---|
| 2,648,325 | A | 8/1953 | Siple | |
| 3,643,463 | A | 2/1972 | Friedlander et al. | |
| 3,648,765 | A | 3/1972 | Starr | |
| 3,736,764 | A | 6/1973 | Chambers et al. | |
| 4,424,916 | A * | 1/1984 | Pearson | A47K 5/18 222/93 |
| 4,691,762 | A | 9/1987 | Elkins et al. | |
| 4,856,294 | A | 8/1989 | Scaringe et al. | |
| 5,115,947 | A | 5/1992 | McDonnell et al. | |
| 5,692,238 | A | 12/1997 | Watson, Jr. | |

(Continued)

*Primary Examiner* — Charles P. Cheyney

(74) *Attorney, Agent, or Firm* — AFMCLO/JAZ; Jeffrey V. Bamber

(57) ABSTRACT

Personal hydration systems with cooling and/or warming capability, and the components thereof are disclosed. The personal hydration systems may include a liquid transport system for transporting cooling or heating fluid between a reservoir and a pad, which pad is configured for wearing adjacent to a wearer's body. A pump is provided for pumping the liquid through the system. A drinking tube is connected to the system for removing liquid from the system. Liquid can be removed from the system for drinking by sucking on the end of the drinking tube. A check valve is used to bypass the pump so the user will not have to suck the liquid through the pump. Alternatively, liquid can be removed by spraying the liquid out of the drinking tube using the power of the pump.

6 Claims, 13 Drawing Sheets

(56) References Cited

U.S. PATENT DOCUMENTS 7,007,502 B2 * 3/2006 Kreutzmann ..... B60N 3/18 62/530
7,056,282 B2 6/2006 Chester et al.
7,073,688 B2 7/2006 Choi et al.
7,124,593 B2 10/2006 Feher
7,373,969 B2 5/2008 Chambers
7,509,692 B2 3/2009 Elkins et al.
7,565,705 B2 7/2009 Elkins et al.
7,735,149 B2 6/2010 Jarvis
7,762,096 B2 7/2010 Fuchs
8,136,702 B2 3/2012 Skillern et al.
8,182,151 B2 5/2012 Dodgen
8,220,664 B1 7/2012 Teetzel et al.
8,276,789 B2 * 10/2012 Emenheiser ..... A45F 3/16 224/148.1
8,322,156 B2 12/2012 Searle
9,222,757 B2 12/2015 Seuk
9,339,066 B2 5/2016 Codner et al.
9,402,763 B2 * 8/2016 Bledsoe ..... A61F 7/10
9,480,762 B2 * 11/2016 Wang ..... A61L 2/18
9,486,018 B2 11/2016 Coats, IV et al.
9,624,083 B2 * 4/2017 Tuggle ..... B67D 1/0004
9,624,089 B1 4/2017 Ostrom
9,877,572 B2 1/2018 Hopmeier
9,902,605 B2 2/2018 Lux et al.
10,470,554 B2 * 11/2019 Kovac ..... B05B 9/043
2004/0079517 A1 * 4/2004 Bueley ..... A41D 13/0053 165/138
2007/0221692 A1 * 9/2007 Witten ..... A42B 3/048 224/148.2
2010/0101253 A1 * 4/2010 Searle ..... A41D 13/0025 62/259.3
2010/0307715 A1 * 12/2010 Emenheiser ..... A45F 3/16 165/47
2011/0036861 A1 * 2/2011 Hillel ..... F25D 31/002 210/104
2019/0059562 A1 2/2019 Escava et al.
2019/0274377 A1 9/2019 Yue
2019/0367172 A1 12/2019 Carver et al.
2020/0281284 A1 * 9/2020 McAllister ..... A41D 13/0053

* cited by examiner

PERSONAL HYDRATION SYSTEM WITH COOLING OR WARMING CAPABILITY

This application is a division of application Ser. No. 17/232,183 filed Apr. 16, 2021, which claims the benefit of and priority to prior filed Provisional Application Ser. No. 63/049,729, filed Jul. 9, 2020, which is expressly incorporated herein by reference.

RIGHTS OF THE GOVERNMENT

The invention described herein may be manufactured and used by or for the Government of the United States for all governmental purposes without the payment of any royalty.

FIELD OF THE INVENTION

The present invention relates generally to personal hydration systems and personal cooling or warming systems, and more particularly to personal hydration systems with cooling and/or warming capability, and the components thereof.

BACKGROUND OF THE INVENTION

Personal hydration systems have been developed to allow users to drink while engaged in physical activities. Such systems often include a liquid reservoir that a user carries in a back pack or a waist pack, and a long drinking tube that extends from the liquid reservoir to allow the user to drink from the tube. The drinking tube may have a bite valve at the end that allows the user to start the flow of liquid by biting on the valve. Personal hydration systems of the type described above generally do not provide the ability to cool or warm the outside surfaces of a wearer's body.

Numerous attempts have been made to develop personal cooling systems. Often such efforts have involved creating a garment, such as a vest, and filling the garment with ice, or some other cooling substance. Garments have also been developed that circulate a cooling fluid through the garment.

Cooling systems of the type described above typically suffer several drawbacks. One drawback is that providing a wearer with an additional garment to wear in order to cool themselves is an inherent disadvantage since it requires the user to add an additional layer of clothing when they may already be operating under hot conditions. Another drawback of many such garments is that after a period of time the cooling substance will become warmer and lose its ability to cool the wearer. When this happens, in some cases, the wearer may either have to continue to wear or carry the liquid-containing garment, or discard garment.

SUMMARY OF THE INVENTION

The present invention overcomes the foregoing problems and other shortcomings, drawbacks, and challenges of prior personal hydration systems and personal cooling systems. While the invention will be described in connection with certain embodiments, it will be understood that the invention is not limited to these embodiments. To the contrary, this invention includes all alternatives, modifications, and equivalents as may be included within the spirit and scope of the present invention.

This invention relates to a wearable personal hydration system with cooling and/or warming capability. The invention can be alternatively thought of as a cooling and/or heating device with hydration capability. The method of using this system is also described herein. This wearable system for cooling or warming a user can be integrated into an article that the user may wear without requiring the user to add an additional layer of clothing. The system permits liquid in a reservoir, such as water, to be pumped into a thermally conductive pad adjacent the user's body. The liquid either thermally cools or heats the user, depending on the temperature of the liquid. After passing through the thermally conductive pad, the liquid may then be recirculated back into the reservoir. A pump is provided for pumping the liquid through the system. A drinking tube is connected to the system for removing liquid from the system. A check valve may be provided so that when the user is using the drinking tube, the user will not have to suck water through the pump. Liquid may be removed from the system by drinking, in which case the check valve may be activated by sucking on the end of the drinking tube. Alternatively, liquid may be removed by forcefully spraying liquid out of the drinking tube using the power of the pump for drinking, or in order to fill other receptacles, irrigate wounds, or for other purposes.

It should be understood that in some embodiments, the present invention may relate to the entire personal hydration system, including the liquid reservoir and the pad. In other embodiments, the present invention may relate to certain components thereof (such as only the components used to transport liquid), and may not require that a liquid reservoir, a pad, and/or other components be a part thereof. For instance, in some embodiments, the present invention may relate to a liquid transport system which comprises only the components such as the conduits and pump that are used to transport liquid, and does not require that a liquid reservoir or a pad be a part thereof.

A method of hydrating and/or cooling or warming a user of the wearable personal hydration system with cooling and/or warming capability is also disclosed herein. The method comprises the steps of: a) wearing a personal hydration system as described herein with temperature adjustment capability; b) providing the reservoir with a supply of chilled or heated liquid; and c) directing liquid in the reservoir into one of multiple flow paths. These flow paths comprise: (a) a first flow path from the reservoir through the pump to the pad; (b) a second flow path from one of the reservoir and the pad to the free end of the drinking tube without passing through the pump; and (c) a third flow path from one of the reservoir and the pad to the free end of the drinking tube using the pump. The order of these steps can be varied so that they may be performed in any suitable order.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

FIG. 9 is a plan view of the personal hydration system shown in FIG. 1 showing the flow of liquid when the pump is on.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

The present invention relates generally to personal hydration systems and personal cooling and/or warming systems, and more particularly to personal hydration systems with cooling and/or warming capability, and the components thereof. The invention can alternatively be thought of as a wearable cooling and/or heating device with hydration capability. The terms "temperature adjustment capability" or "body temperature adjustment capability" may be used herein to refer to a system that is capable of providing cooling and/or warming capability.

The personal hydration systems are portable and, thus, the entire system is capable of being worn by an individual. The personal hydration systems described herein may be suitable for use by soldiers, law enforcement officers, firefighters, hikers, bicycle riders, motorcyclists, and confined space workers.

Figures 1, 1A:
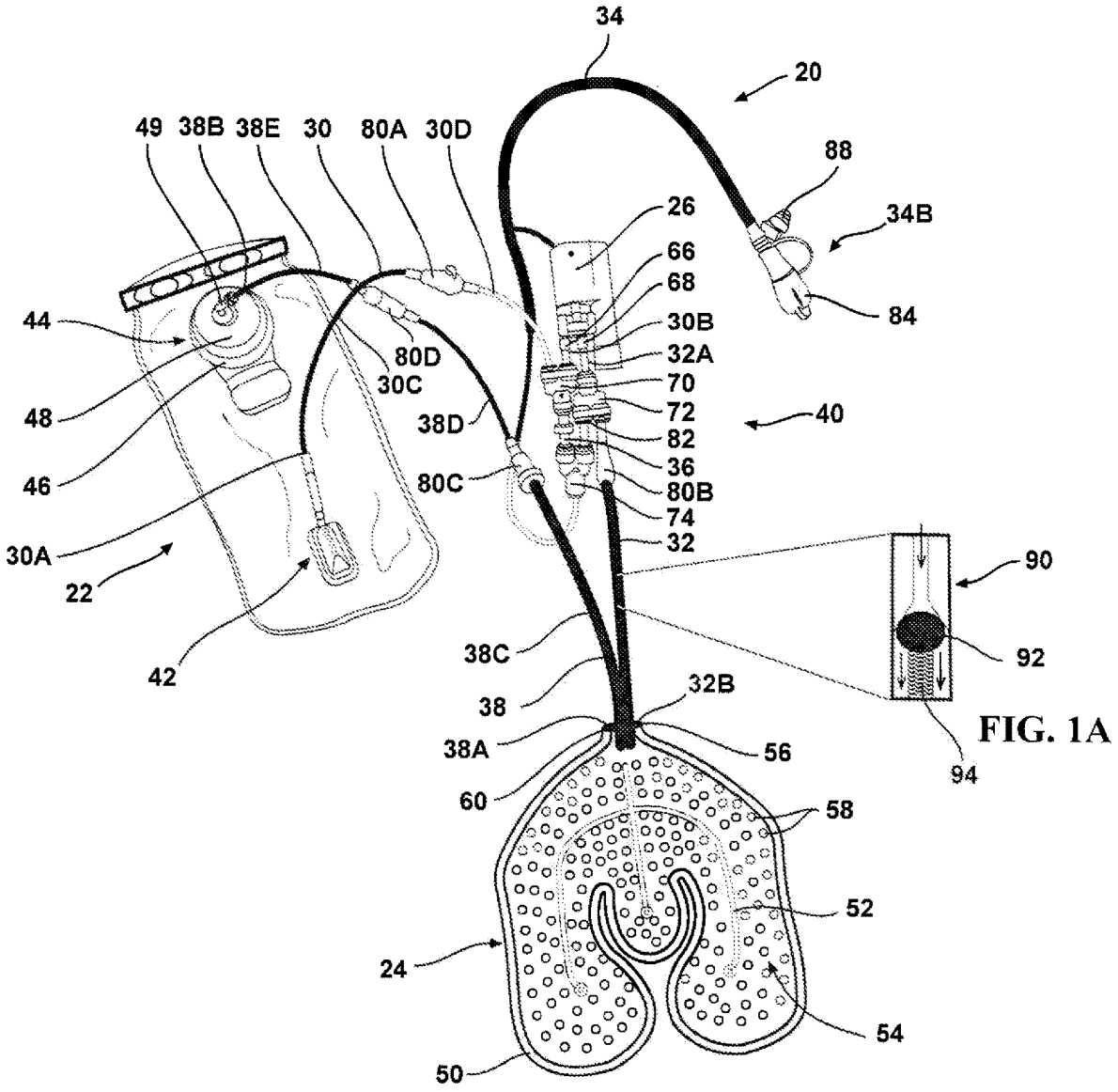
FIG. 1 is a plan view of one embodiment of a personal hydration system with cooling and/or warming capability, with the same being laid out and not associated with a supporting garment.
FIG. 1A is a schematic view showing the interior of the pressure relief valve.

FIG. 1 shows one non-limiting embodiment of a personal hydration system 20 with cooling and/or warming capability. The personal hydration system 20 comprises: a reservoir ("liquid reservoir" or "bladder") 22, a pad 24 configured for wearing adjacent to a wearer's body, a liquid pump 26 configured for generating the flow of a liquid, and a plurality of conduits 30, 32, 34, 36, and 38. At least some of the conduits may be configured to be arranged in a closed loop configuration when joined to the reservoir 22 and the pad 24. One of the conduits 34 is arranged to allow the wearer to drink from the free end thereof.

It should be understood that in some embodiments, the present invention may relate to the entire personal hydration system 20, including the reservoir 22 and the pad 24. In other embodiments, the present invention may relate to certain components thereof (such as only the components used to transport liquid), and may not require that a liquid reservoir, a pad, and/or other components be a part thereof. For instance, in some embodiments, the present invention may relate to the "liquid transport system" 40 (see FIG. 2), which comprises only the components such as arrangement of the conduits and pump that are used to transport liquid, and does not require that a reservoir 22 or a pad 24 be a part thereof. The liquid transport system 40 is a component of the personal hydration system 20 and is an invention in its own right.

The reservoir 22 can comprise any suitable type of liquid container that is portable and wearable by an individual user. It may be desirable for the reservoir 22 to be closed and thermally insulated (or to be provided with insulating material joined thereto) in order to maintain the temperature of the substance (e.g., water and/or ice) contained therein. In other cases, even if the reservoir is not thermally insulated, the reservoir can be provided inside an insulated pocket. The reservoir 22 can be a commercially available liquid reservoir that is of a standard type, or it can be a Chemical, Biological, Radiological, and Nuclear (CBRN) liquid reservoir. For example, the reservoir may comprise a commercially available hydration reservoir, and can be used with the same supporting accessory that is designed to carry the reservoir, such as a back pack.

The reservoir 22 may be provided with an outlet port 42 at the bottom of the reservoir and a fill port 44 near the top of the reservoir. The fill port 44 provides an opening into which liquid (or solids such as ice) may be poured into or removed from the reservoir 22. The fill port 44 may be surrounded by a collar 46 which may be threaded and provided with a cap 48 for closing the same.

In addition, a return line, or segment thereof, may be integrated into the fill cap 48 of the reservoir 22 to allow the liquid to be recirculated back into the reservoir 22. For example, the cap 48 may have an opening therein, and a 90 degree elbow threaded fitting 49 can be inserted into the opening in the cap 48 in order to allow liquid to be returned to the reservoir 22 through the cap 48.

The reservoir 22 can contain any substance that is suitable for cooling and/or heating the wearer's body. Suitable substances include, but are not limited to liquids such as water in liquid form (or some of which may be in the form of ice).

Such substances may exclude non-consumable liquids, and gases, such as air. It is desirable for the liquid to comprise water so that it will be capable of being consumed by the wearer and/or used for other purposes as described herein. Having the same liquid serve a cooling or heating function as well as a hydration function eliminates the need for the wear to carry a separate reservoir of a heat transfer fluid (such as polyethylene glycol) that cannot be consumed by the wearer. The reservoir 22 can contain any suitable amount of liquid. For example, the reservoir 22 can contain about 1 to about 3 L of liquid. The liquid holding capacity of the reservoir 22 may be greater than that of the pad 24 so that one or more volumes of liquid may be pumped to the pad 24 to heat or cool the wearer, and then recirculated back to the reservoir 22 where such recirculated liquid will be mixed with the liquid in the reservoir 22. In some cases, the liquid holding capacity of the reservoir 22 may be 10%, 20%, 30%, . . . up to 500% or more, greater than that of the pad 24.

The liquid in the reservoir 22 may be cooled or heated to any suitable temperature. For instance, the liquid in the reservoir 22 may be cooled or heated so that it contains at least some liquid that is at an initial temperature that differs from ambient temperature where the personal hydration system 20 will be worn. The liquid may differ from the ambient temperature by at least about 2, 3, 4, 5, . . . up to 50 or more degrees Fahrenheit. If the liquid is water, it may for example, be chilled to a temperature of between about 35-50° F. The liquid in the reservoir 22 can be cooled by refrigerating the liquid prior to adding it to the reservoir, or by adding ice to the reservoir. Alternatively, the entire reservoir 22 with the liquid therein can be refrigerated before it is worn by a user. If the reservoir 22 contains ice, sufficient liquid should be present at the time needed for cooling the wearer's body in order to permit circulation from the reservoir 22 to the pad 24. If it is desired to use the personal hydration system 20 to warm the wearer's body, the liquid can be heated before it is added to the reservoir.

The pad 24 for wearing adjacent to a wearer's body can comprise any suitable type of cooling and/or heating pad that provides for the circulation of a cooling or heating liquid therethrough. The pad 24 may be thermally conductive so that it allows the liquid to either thermally cool or heat the user, depending on the temperature of the liquid. The pad 24 may be comprised of two layers of material (typically flexible material such as film) that are bonded together adjacent to their periphery to provide a relatively flat sealed compartment with a liquid tight perimeter seal 50. The pad 24 may be bonded together at various bond locations 52 that are inside of the periphery to provide internal flow channels 54 for directing the flow of liquid through the pad 24. Spot bonds 58 can also be provided to hold the layers of the pad together and optionally to add turbulence to the flow of liquid through the pad 24. The pad 24 may have an inlet opening 56 which allows liquid to enter the interior of the pad 24 via a pad inflow line 32 and an outlet opening 60 that allows liquid to exit the pad via a return line 38.

The pad 24 may be configured for wearing adjacent to any suitable portion of a wearer's body. When it is said that the pad 24 is configured for wearing adjacent to a wearer's body, direct contact with the wearer's body is not necessary. In some cases, the pad 24 may be in direct contact with the wearer's skin. In other cases, there may be some intervening material between the pad 24 and the user's skin. The pad 24, however, sufficiently close to the wearer's body and the intervening material should be such that it does not interfere with the ability of the liquid in the pad 24 to cool or warm the wearer's body as desired.

The pad 24 may be configured for wearing adjacent any desired part or parts of the wearer's body including, but not limited to the wearer's chest, back, sides of the torso, waist, neck, and/or head. In still other embodiments, a plurality of pads 24 may be provided for wearing adjacent the same or different parts of a wearer's body. In the embodiment shown in the drawings, the pad 24 is configured and positioned to be worn near a portion of the wearer's back.

Figure 2:
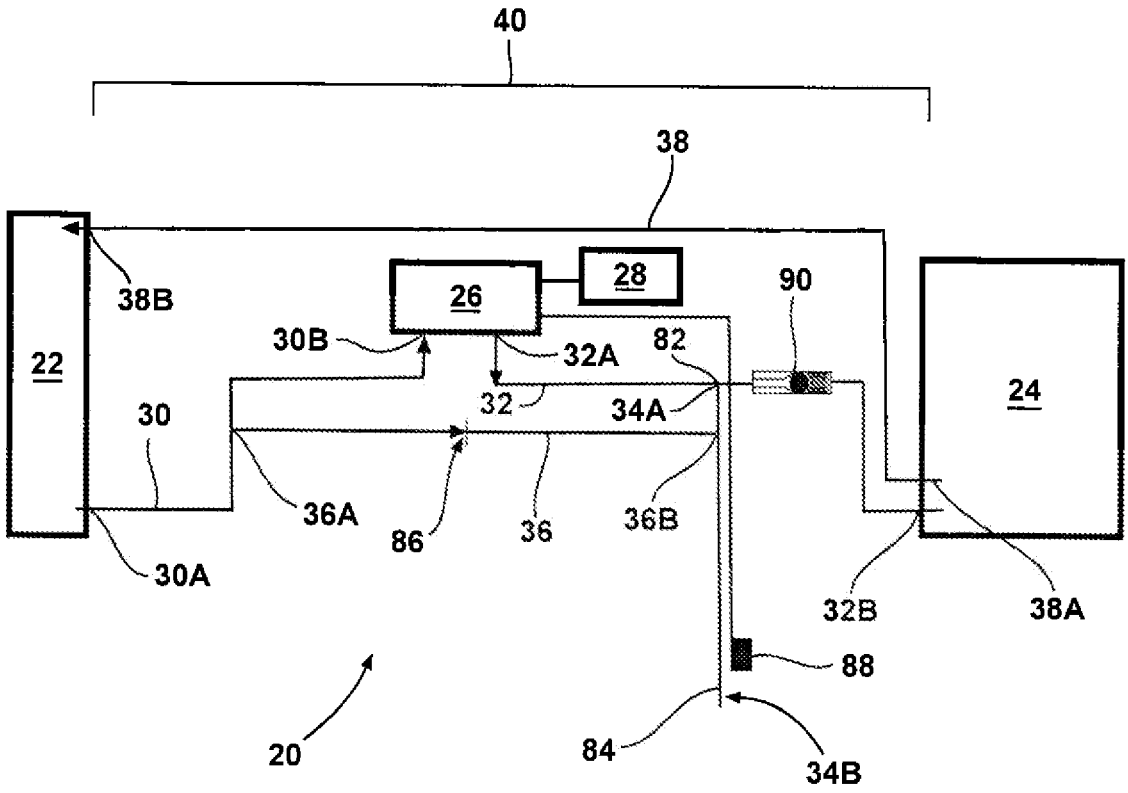
FIG. 2 is a schematic flow diagram of one embodiment of the personal hydration system.

The liquid pump 26 can comprise any suitable type of pump that is capable of generating the flow of a liquid. Suitable types of pumps include, but are not limited to diaphragm pumps, manual pumps, and passive pumps, etc. Passive pumps are non-electrically powered and are described in greater detail below. The pump 26, if powered, can comprise a motor, such as an electric motor. A power supply can be provided for powering a motorized pump. The power supply may comprise one or more batteries, and/or a solar panel 28 (as shown in FIG. 2) which may be connected to the motor by wires. If batteries are used, they may be rechargeable, or non-rechargeable. The pump assembly of the embodiment of the personal hydration system 20 shown in FIG. 1 is shown in greater detail in FIG. 3 and includes a housing with a motor and battery compartment. In the embodiment shown, the pump 26 is a Gikfun Mini R385 integrated diaphragm pump and power supply assembly with a flow of 1.8 L/min. that is available from gikfun.com. The battery compartment contains three 123A batteries. Such a pump assembly may weigh about 10-12 oz.

The pump 26 can be used for several purposes. The pump 26 can pump the liquid from the reservoir 22 to the pad 24 and then recirculate the liquid back into the reservoir 22. Additionally, the pump 26 allows for pressure to be applied to the liquid in a flexible drinking tube, allowing the user to drink from the drinking tube without sucking liquid through the drinking tube, or to forcefully spray liquid from the drinking tube. The pump 26 may comprise an inlet 66 and an outlet 68. The diaphragm pump is also particularly useful because it can pump air if the reservoir 22 is empty. This allows the system to be purged of all liquid in preparation of the personal hydration system 20 for storage.

The personal hydration system 20 comprises a plurality of liquid conduits. There can be any suitable number of conduits. In the embodiment shown in FIG. 1, there are five conduits 30, 32, 34, 36, and 38. Each of the conduits has a first end portion and a second end portion. The first end portion of the conduits will be designated with the reference number of the conduit followed by the letter A. The second end portion of the conduits will be designated with the reference number of the conduit followed by the letter B. The conduits may be flexible tubes, or in some cases particularly if a conduit is relatively short in length, the conduit may be a more rigid tube. Any, or all, of the conduits may be insulated.

The first conduit (or "outflow line") 30 has a first end portion 30A and a second end portion 30B. The first end portion 30A of the first conduit 30 is configured for connecting to a reservoir 22. The second end portion 30B of the first conduit 30 is connected to the inlet 66 of the pump 26. The second end portion 30B of the first conduit 30 may be directly or indirectly connected to the inlet 66 of the pump 26. In the embodiment shown in FIG. 1 (and as shown in greater detail in FIG. 3), the first conduit 30 may pass through and be connected to one inlet of a first three inlet (or three-way) connector 70 before it is connected to the inlet 66 of the pump 26. The three inlets of the connector 70 are designated by reference numbers 70A, 70B, and 70C. The first three inlet connector 70 can comprise a T-shaped connector, a Y-shaped connector, or it can be replaced with a conduit that has three inlets or branches. One suitable three-way connector is a ⅜" push-to-connect T fitting.

The terms "connected" and "joined", as used herein, encompass configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The terms "connected" and "joined" include both those configurations in which an element is temporarily joined to another element, or in which an element is permanently joined to another element.

Figure 3:
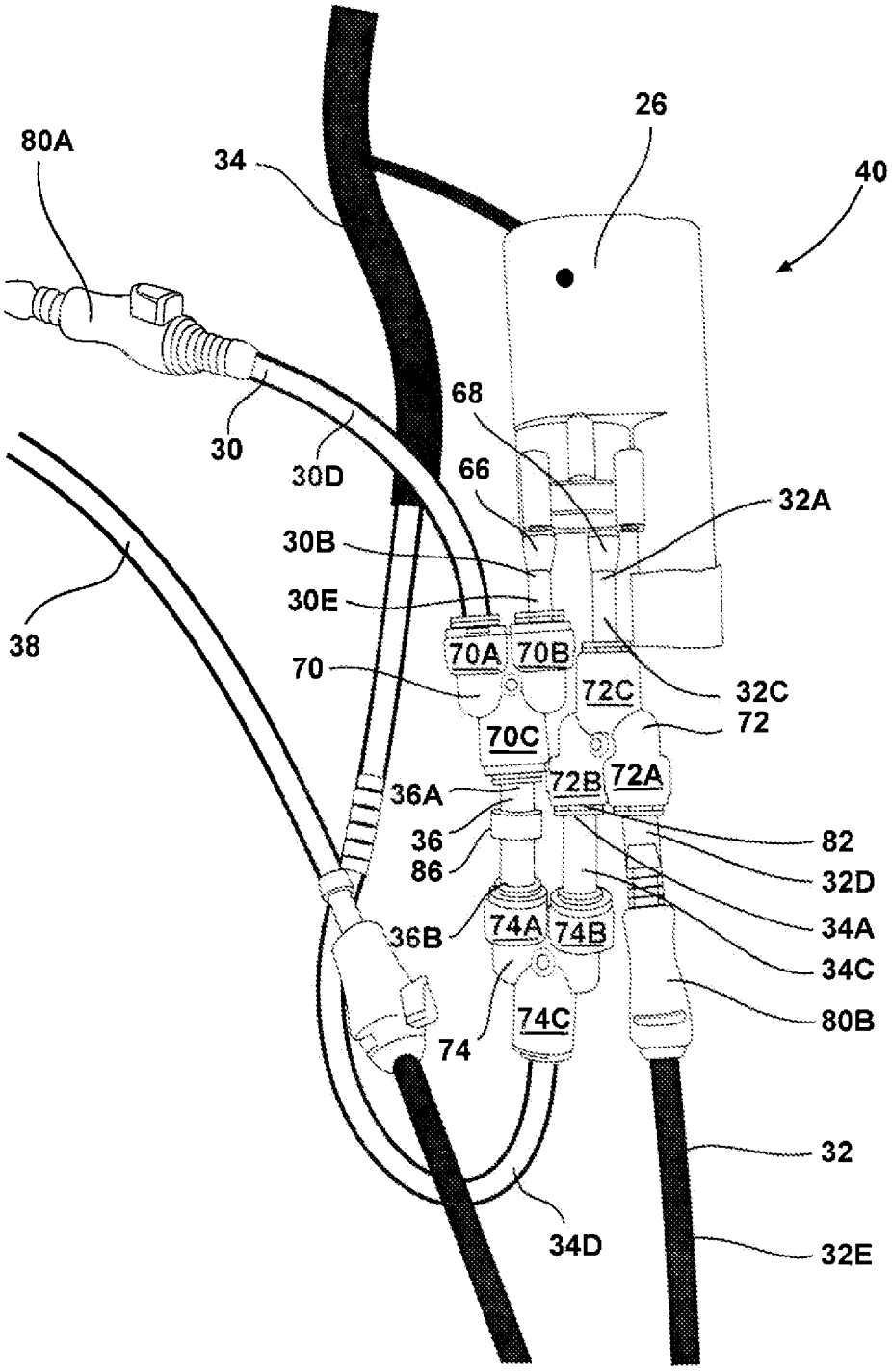
FIG. 3 is an enlarged plan view of the portion of FIG. 1 containing the pump and the associated connections thereto.

The first conduit 30, as is the case with any of the other conduits described herein, may optionally be comprised of one or more (that is, a plurality of) portions which may be in the form of conduit segments. Such segments may be joined together for any suitable purpose including to provide the conduit with quick release connections between the conduit and other components of the personal hydration system 20. FIGS. 1 and 3 show that the first conduit 30 may comprise three segments: first segment 30C, second segment 30D, and third segment 30E. The first and second segments 30C and 30D may be joined to each other by a first quick release component 80A. The second end of the second segment 30D may be joined to inlet 70A of the first three inlet connector 70. As shown in FIG. 3, the third segment 30E may be joined at one end to inlet 70B of the first three inlet connector 70, and at the other end to the inlet 66 of the pump 26. The first conduit 30 is considered to extend continuously through the first quick release component 80A and the first three inlet connector 70. Any the conduits described herein that have segments that are joined by quick release components or other types of connectors will be considered to extend continuously through those components or connectors, and will be in fluid communication with each of its segments. The terms "fluid communication" and "liquid communication", as used herein mean that liquid can flow through and between the components that are in fluid or liquid communication.

The second conduit (or "pad inflow line") 32 has a first end portion 32A and a second end portion 32B. The first end portion 32A of the second conduit 32 is connected to the outlet 68 of the pump 26, and the second end portion 32B of the second liquid conduit 32 will be configured for connecting to the pad 24 that is worn adjacent to a wearer's body. As shown in FIG. 3, the second conduit 32 may comprise three segments comprising a first segment 32C, a second segment 32D, and a third segment 32E. In the embodiment shown in FIG. 1 (and as shown in greater detail in FIG. 3), the second conduit 32 may pass through and be connected to one inlet of a second three inlet (or three-way) connector 72 after it is connected to the outlet 68 of the pump 26. The inlets of the second connecter 72 are designated by reference numbers 72A, 72B, and 72C. In addition, the second and third segments 32D and 32E may be joined together with a second quick release component 80B to allow the second conduit 32 to be removably joined from fluid communication with the pump 26.

The third conduit (or "drinking tube") 34 has a first end portion 34A and a second end portion 34B. The first end portion 34A of the third conduit 34 is connected at a connection location 82 to the second conduit 32 between the first and second end portions 32A and 32B of the second conduit 32. As shown in FIG. 3, the third conduit 34 may comprise two segments comprising a first segment 34C and a second segment 34D. The first segment 34C can be a relatively short segment that has one end joined to inlet 72B of three inlet connector 72, and its other end joined to inlet 74B of third three inlet connector 74. The second segment 34D can have one end joined to inlet 74C of third three inlet connector 74 and its other end forming the second end portion 34B. The second end portion 34B of the third conduit 34 is configured for drinking liquid therefrom. The drinking tube 34 is in liquid communication with the reservoir 22 that is used to cool or heat the wearer (unlike systems in which the heat transfer fluid is not drinkable). A bite valve 84 may be joined to the second end portion 34B of the third conduit 34.

The fourth conduit (or "bypass line") 36 has a first end portion 36A and a second end portion 36B. As shown in detail in FIGS. 2 and 3, the first end portion 36A of the fourth conduit 36 is connected to the first conduit 30 between the first and second end portions 30A and 30B of the first conduit 30. This connection is made through the first three inlet connector 70. The second end portion 36B of the fourth conduit 36 is connected to the third conduit 34 between the first and second end portions 34A and 34B of the third conduit 34. This connection is made through the third three inlet connector 74.

The fifth conduit (or "return line") 38 provides a path for liquid to be recirculated from the pad 24 back to the reservoir 22. The fifth conduit 38 has a first end portion 38A and a second end portion 38B. The first end portion 38A of the fifth conduit 38 is configured for connecting to the pad 24. The second end portion 38B of the fifth conduit 38 is configured for connecting to the reservoir 22. FIG. 1 shows that the fifth conduit 38 may comprise three segments: first segment 38C, second segment 38D, and third segment 38E. The first and second segments 38C and 38D may be joined to each other by a third quick release component 80C. The second and third segments 38D and 38E may be joined to each other by a fourth quick release component 80D.

The liquid transport system 20 is configured for directing the flow of liquid from the reservoir 22 into multiple flow paths when the liquid transport system is joined to a reservoir and a pad and when the reservoir contains a supply of chilled or heated liquid. These flow paths comprise: (a) a first flow path from the reservoir 22 through the pump 26 to the pad 24; (b) a second flow path from one of the reservoir 22 and the pad 24 to the free end 34B of the drinking tube 34 without passing through the pump 26; and (c) a third flow path from one of the reservoir 22 and the pad 24 to the free end 34B of the drinking tube 34 using the pump 26.

The outflow line 30, the pad inflow line 32, and return line 38 form a closed loop system with the reservoir 22 and the pad 24. It would be possible, but less than desirable to simply have an initial one-way flow of at least some liquid from the reservoir 22 to the pad 24 for cooling/heating without a return line 38. The pad 24 in such a case, could be thought of as a remote reservoir. However, in such a case, once the liquid in the pad 24 reaches a temperature where it is no longer able to serve its cooling or heating function, the liquid in the pad 24 would not be able to recirculated back to the reservoir 22 to make room for (and be displaced by) a subsequent volume of chilled or heated liquid to be transported from the reservoir to the pad 24 for cooling or warming the user. In addition, since there would be no recirculation back to the reservoir 22, the user would not be able to drink the volume of liquid in the pad 24 that has served its cooling or warming function because that liquid would not come back to the reservoir 22.

As shown in FIGS. 2 and 3, a check valve 86 may be provided in line with the fourth conduit 36. The check valve 86 opens when suction is applied to the second end portion 34B of the third conduit, drinking tube 34, so that liquid may by-pass the pump 26 and flow to the second end portion 34B of the third conduit 34. This ensures that when the user wants to drink from the reservoir using the drinking tube 34, the user does not have to attempt to suck liquid through the pump 26.

A switch 88 may be electrically connected (such as by wires) to the pump 26 for turning the pump 26 on and off. The switch 88 is optional if the system uses a manual pump or a passive pump. The switch 88 may be placed in any suitable location within the system. In the embodiment shown in FIG. 1, the switch 88 is located for convenient access by the user on the second end portion 34B of the third liquid conduit, drinking tube 34.

As shown in FIGS. 1 and 2, a pressure relief valve 90 may be provided that is in-line with the second conduit 32. The pressure relief valve 90 may be located between the connection location 82 of the third conduit 34 and the second end portion 32B of the second conduit 32. FIG. 1A shows the pressure relief valve 90 in greater detail. The pressure relief valve 90 allows for the priority of liquid flow to go through the bite valve 84, when the bite valve 84 is open. The pressure relief valve 90 is shown in a closed position in FIG. 1A. Arrows show how liquid will flow through the pressure relief valve 90 when the pressure relief valve 90 is opened. As shown by the arrows in FIG. 1A, when the bite valve 84 is closed, the pressure from liquid pumped by the pump 26 will press on the ball 92 and spring 94, and will unseat the ball 92 of the pressure relief valve 90 allowing the liquid to flow in the direction of the arrows through to the pad 24.

The personal hydration system 20 is portable and wearable by an individual user. The personal hydration system 20 is configured to be worn and supported by a carrier such as a garment or accessory that a user is intending to wear, and does not require a separate garment to be worn by the user to support the same. For instance, the personal hydration system 20 can be configured to be worn with a body armor ballistic plate carrier, a backpack, or as a standalone vest.

Figure 4:
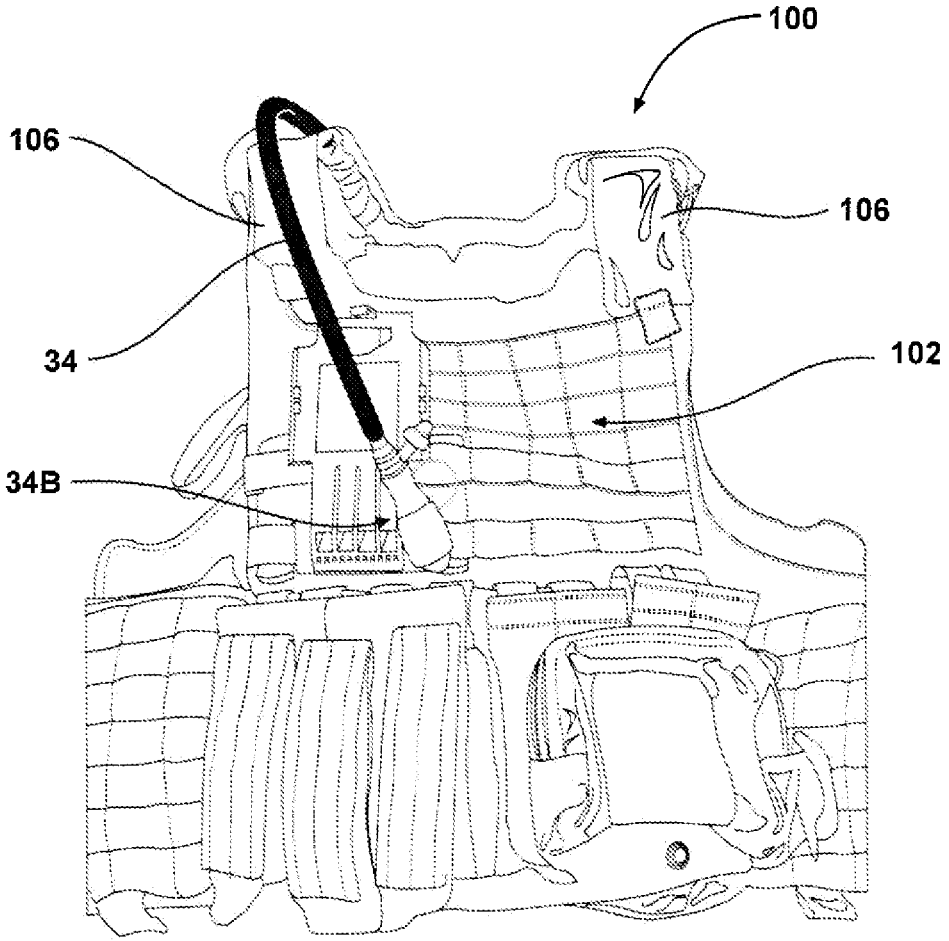
FIG. 4 is a front view of a ballistic vest that has the personal hydration system incorporated therein.

One embodiment of a body armor ballistic plate carrier 100 is shown in FIGS. 4-8. A ballistic plate carrier 100 is a vest capable of carrying rigid armor plates and/or flexible ballistic armor inserts. The plate carrier (or "vest") 100 is typically worn on the outside of clothing. The plate carrier 100 is generally comprised of front and back panel sections 102 and 104 respectively. The front and back panel sections 102 and 104 are connected by shoulder straps 106 and a cummerbund or one or more waist straps 108. The front of the ballistic plate carrier is shown in FIG. 4. FIG. 4 shows that the second end portion 34B of the drinking tube 34 is provided on the front side of the plate carrier for ready access by the user.

Figure 5:
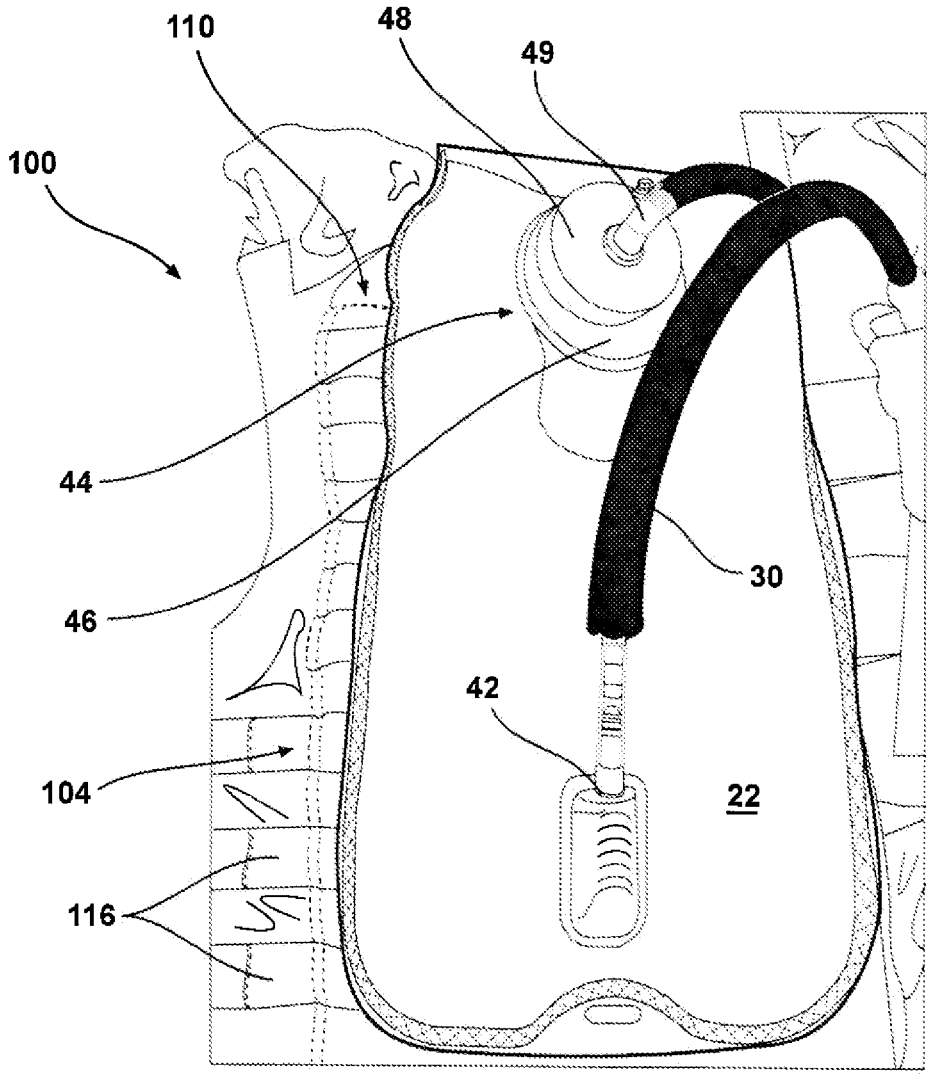
FIG. 5 is a rear view of a ballistic vest showing the reservoir removed from the pocket on back of the vest and overlaid on top of the vest.

FIG. 5 shows the back of the plate carrier 100. In the embodiment shown, the plate carrier 100 has PALS (Pouch Attachment Ladder System) webbing 116 joined to at least the back panel 104 of the plate carrier. The plate carrier 100 may have a removable pouch or pocket 110 on the back of the same for carrying the reservoir 22. The removable pouch or pocket 110 may be MOLLE (MOdular Lightweight Load-carrying Equipment) compatible and can be attached to the vest via the PALS webbing 116. FIG. 5 shows the reservoir 22 removed from the reservoir pocket 110 on back of the vest and overlaid on top of the vest.

The plate carrier 100 also has a pouch or pocket 112 (shown in FIG. 7) for a ballistic plate. The pocket 112 for the ballistic plate may be located inside the layer of material that forms the outside surface of the back panel 104 of the plate carrier. The ballistic plate may be any suitable conventional type of armor plate including, but not limited to a Small Arms Protective Insert (SAPI) or Enhanced Small Arms Protective Inserts (ESAPI) and is not shown. In some embodiments, the cooling/heating pad 24 may be placed in the pocket 112 for the ballistic plate together with the ballistic plate. The cooling/heating pad 24 will be positioned inside the ballistic plate closest to the wearer's body. In other embodiments, the plate carrier 100 may have two or more pockets inside the layer of material that forms the outside surface of the back panel 104 of the plate carrier. For example, the plate carrier 100 may have a first pocket 112 as described above for a ballistic plate, and a second inner pocket located on the inside of the plate carrier relative to first pocket 112. The first and second pockets may share a common wall therebetween. In some cases, the common wall may comprise a flexible ballistic armor material that is used for protection from small arms fire. In this latter embodiment, the cooling/heating pad 24 would be placed in the second inner pocket adjacent the body-facing side of the flexible ballistic armor material. Thus, in any case, the cooling/heating pad 24 will typically be positioned between the wearer's body and the innermost ballistic material.

Figure 6:
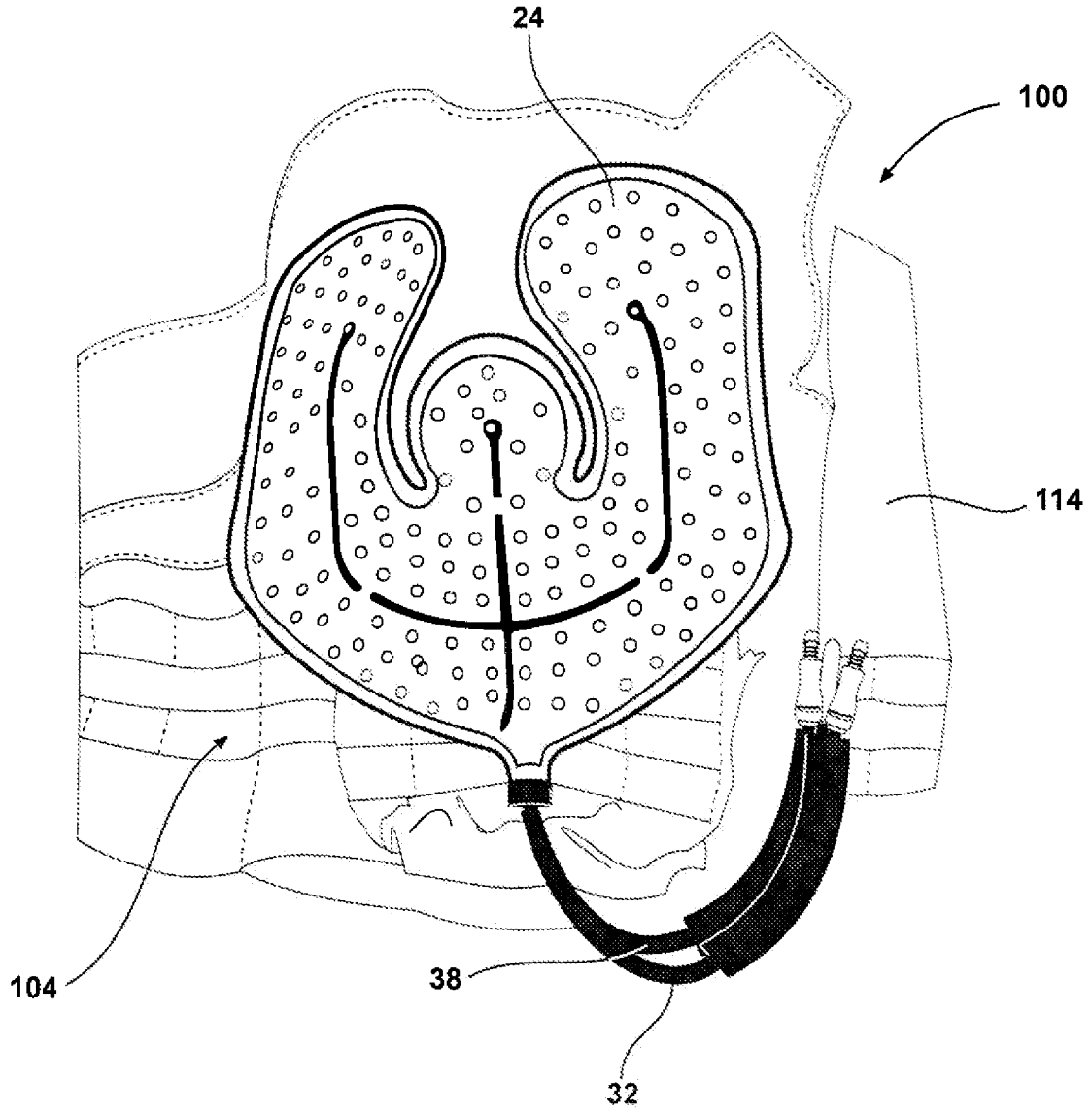
FIG. 6 is a rear view of a ballistic vest showing the pad removed from the pocket on back of the vest and overlaid on top of the vest.
Figure 8:
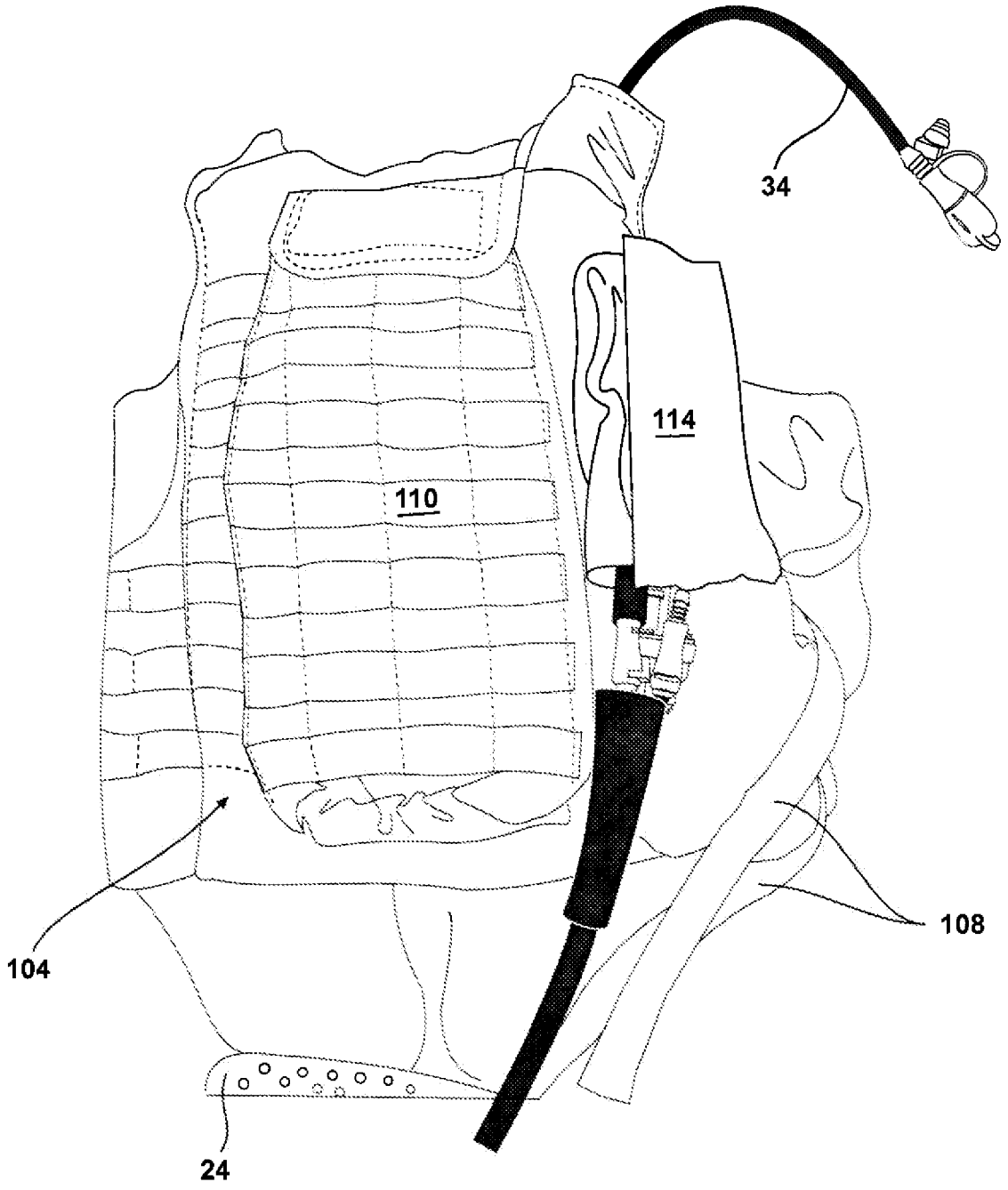
FIG. 8 is a rear view of a ballistic vest with the reservoir in place.

FIG. 6 shows the back of the plate carrier 100 showing the cooling/heating pad 24 removed from the pocket 112 on back of the vest and overlaid on top of the back 104 of the vest. In the embodiment shown in FIG. 6, the pad inflow line 32 and return line 38 are of sufficient length that the pad 24 may be inserted into the pocket for holding the pad from the bottom of the plate carrier 100. FIG. 6 shows that the back of the plate carrier 100 may comprise a component holder ("holder") 114 for holding portions of the liquid transport system 40 components such as the pump 26, valves, and portions of several of the liquid conduits. FIG. 8 shows the holder 114 in a closed configuration.

Figure 7:
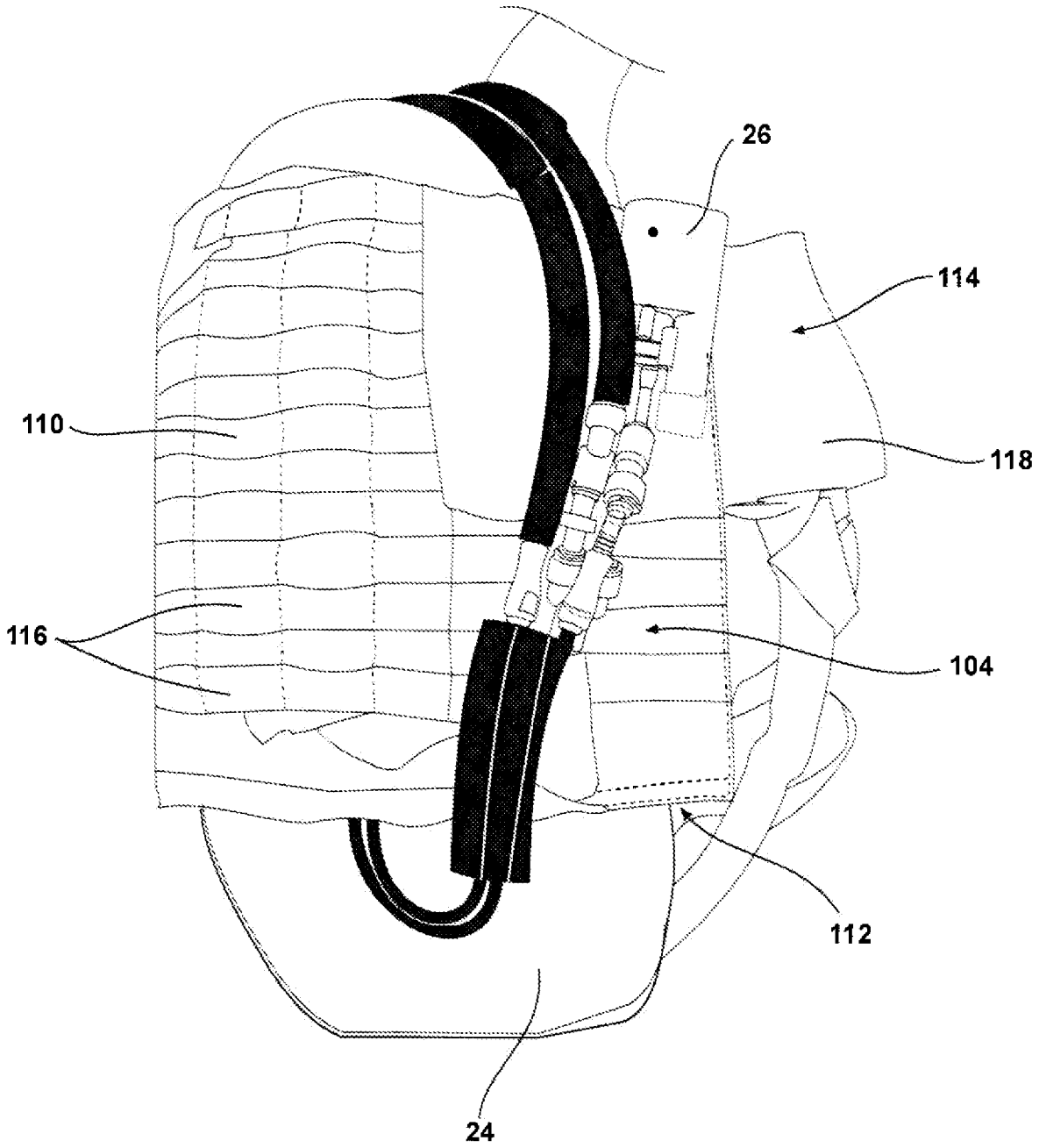
FIG. 7 is a rear view of a ballistic vest showing a portion of the liquid transport components with the covering thereof opened.

FIG. 7 shows the back of the plate carrier 100 with the component holder 114 in an open configuration. The holder 114 can be joined to the plate carrier 100 in any suitable manner. In this embodiment, the holder 114 comprises a piece of material 118 having a hook and loop fastening system such as VELCRO® fastening material thereon to open and close the holder 114. The piece of material 118 may be MOLLE compatible and can be attached to the vest via the PALS webbing 116. One portion of this piece of material 118 can be folded over these portions of the liquid transport components and fastened to another portion thereof.

FIG. 8 shows the back of the plate carrier 100 with the reservoir 22 in place inside the reservoir pocket 110. (The reservoir 22 and several of the other components mentioned herein are not visible in FIG. 8 since they are located within the pockets or other enclosures for the same.) The cooling and/or heating pad 24 is not yet in place inside the pocket 112 for the armor plate. The holder 114 is wrapped around the pump 126 and other portions of the liquid transport system and is closed. Part of the drinking tube 34 extends outwardly from the holder 114 and is sized and configured to pass over one of the shoulder straps 106 (in this case, the right shoulder strap).

To use the personal hydration system 20, the components of the system can be assembled in the configuration shown in FIG. 1. The personal hydration system 20 can then be joined to (for example, integrated into) an article for wearing, such as the plate carrier 100 shown in FIGS. 4-8. If desired, before joining the reservoir 22 to the rest of the system, the reservoir 22 can be filled with the liquid at the desired initial temperature, which will be either cooler or warmer than the ambient temperature. The reservoir 22 and any attached segments of the first and fifth conduits 30 and 38 (such as 30C and 38E) can then be joined to the rest of the system using quick release components 80A and 80D.

The user will wear the article such as the plate carrier 100 together with the personal hydration system 20. The liquid in the reservoir 22 may be maintained as closely as possible to its initial temperature by placing the reservoir 22 in an insulated reservoir pocket, such as pocket 110.

Figure 9:
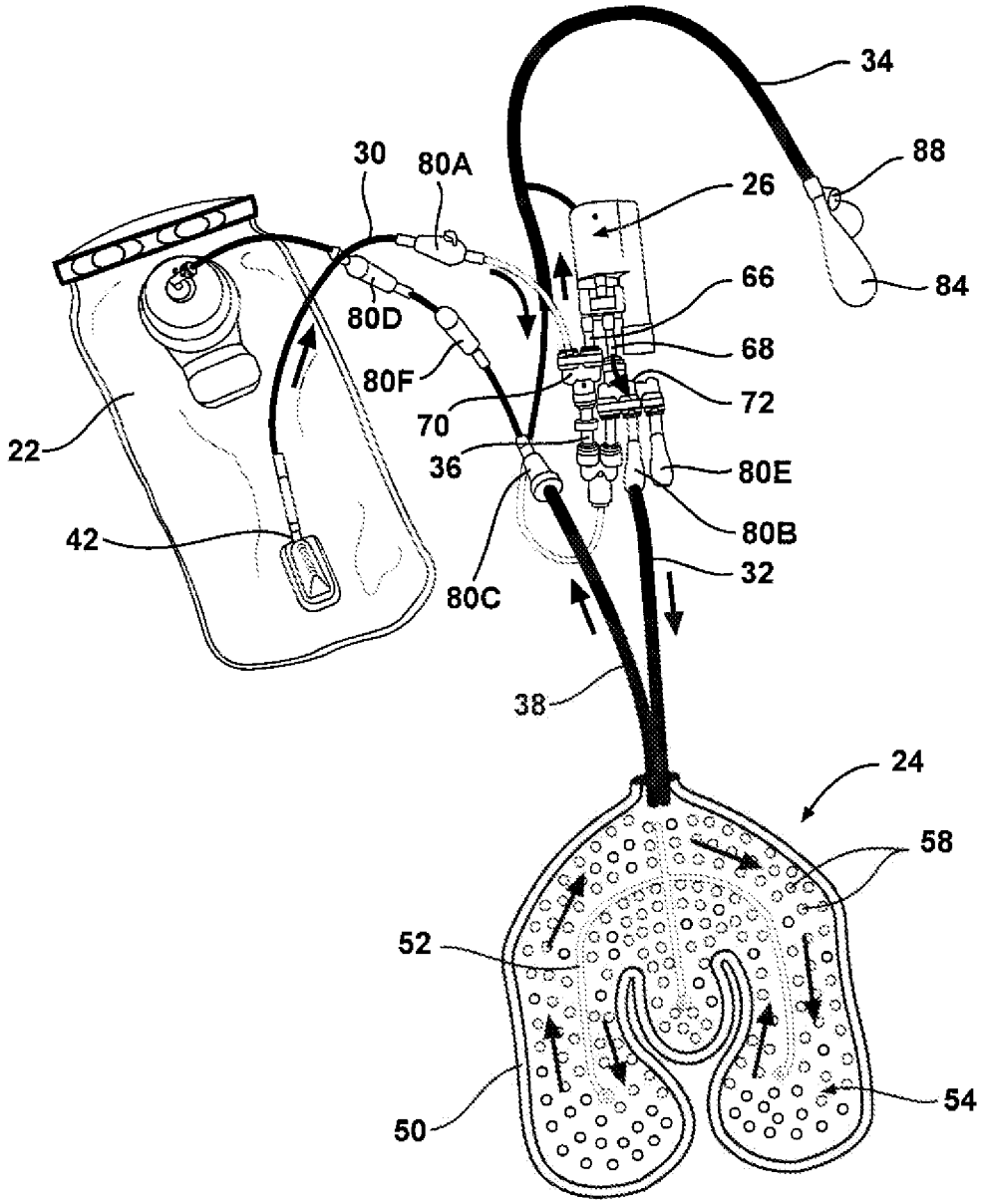

FIG. 9 shows the flow of liquid when the user wishes to activate the cooling or warming capability of the personal hydration system 20. In this case, the user turns on the pump 26 with the switch 88 but does not open the bite valve 84. The liquid will flow out of the reservoir 22 through the outlet port 42 into the outflow line 30, and into the inlet 66 of the pump 26. The liquid will exits the pump 26 via the outlet 68. The liquid then passes through the second three inlet connector 72, and is directed into the pad inflow line 32. The liquid then passes through the flow channels 54 in the pad 24. After passing through the thermally conductive pad 24, the liquid is then recirculated back into the reservoir 22 via the return line 38. The recirculated liquid which has cooled or warmed the wearer will thereafter be at a temperature that is closer to ambient temperature than its initial chilled or heated temperature. It should be understood that the Y-shaped three inlet connectors described herein are optional components for the particular embodiment shown. The components of the liquid transport system 40 can be arranged in any other suitable manner that may not include these connectors.

Figure 10:
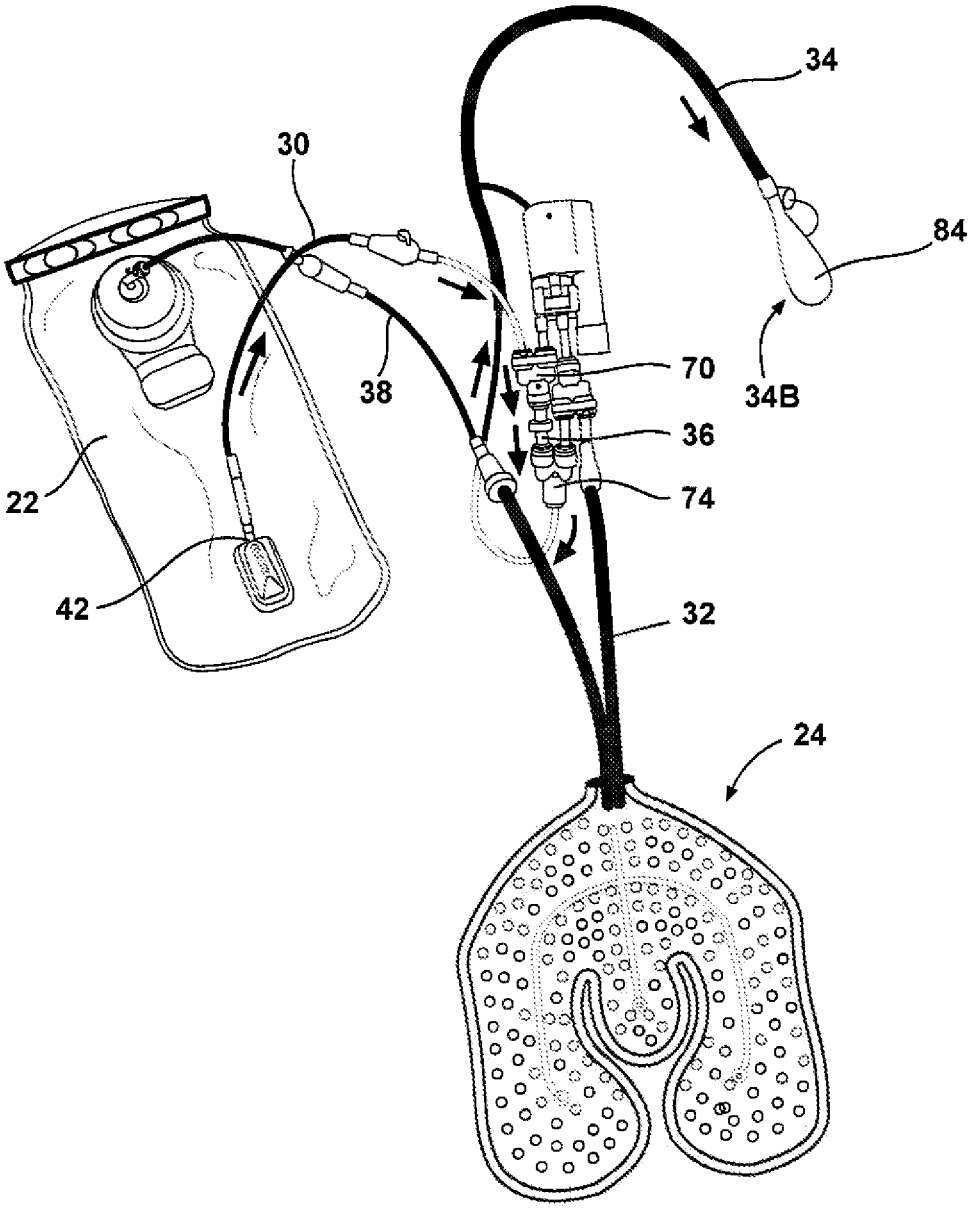
FIG. 10 is a plan view of the personal hydration system shown in FIG. 1 showing the flow of liquid when the pump is off, the bite valve is open, and liquid being drank.

FIG. 10 shows that if the user wishes to drink from the reservoir 22, the user can bite down on the bite valve 84, and suck liquid, such as water through the second end 34B of the drinking tube 34. In this case, the water will flow out of the reservoir 22 through the outlet port 42, and into the outflow line, first conduit 30. The water will pass through the first Y-shaped three inlet connector 70 and into the by-pass line 36. The water will flow through the check valve 86 and will flow through the third Y-shaped connector 74. The water will then pass into the drinking tube 34, and out of the second end 34B of the drinking tube 34.

Figure 11:
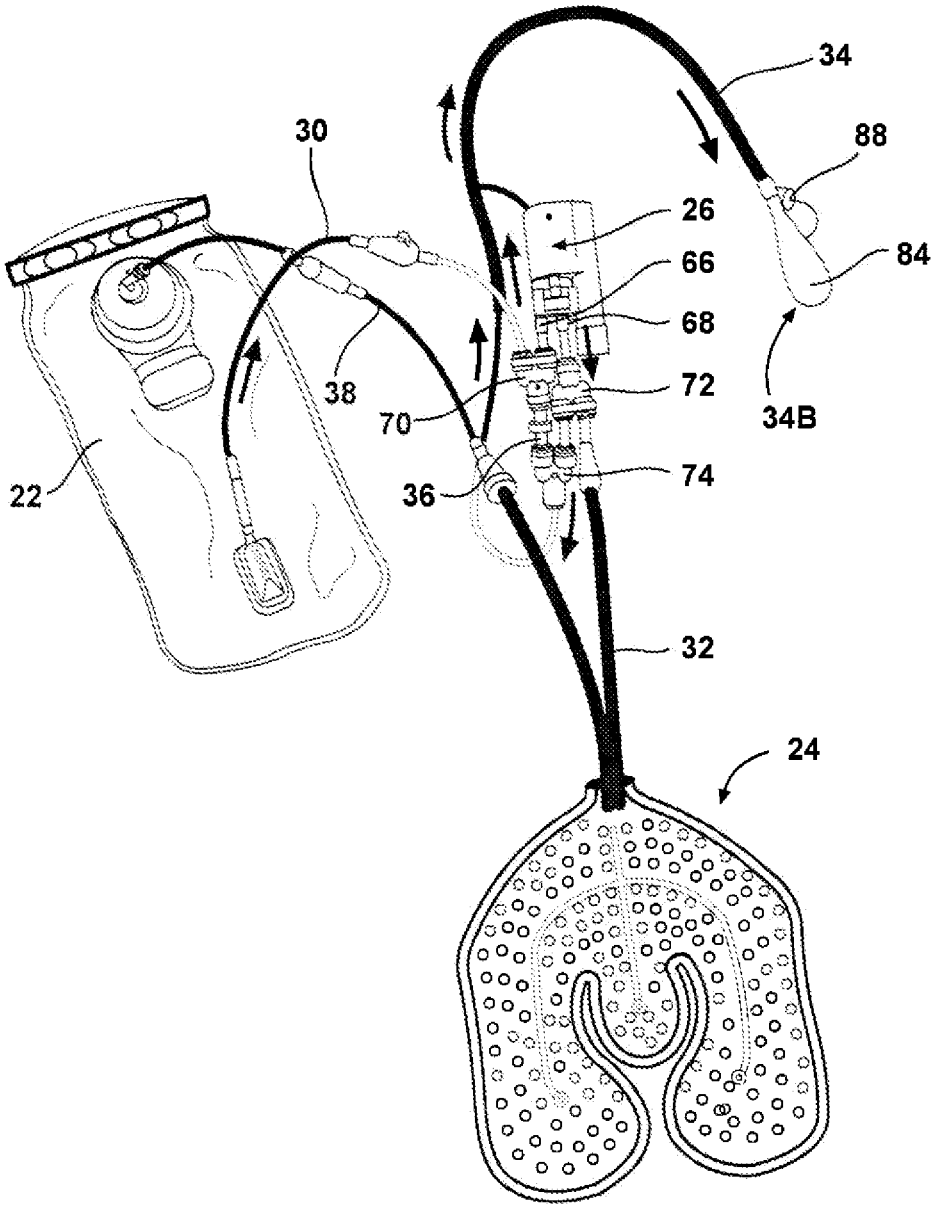
FIG. 11 is a plan view of the personal hydration system shown in FIG. 1 showing the flow of liquid when the pump is on, the bite valve is open and liquid is being removed by pumping to the drinking tube.

FIG. 11 shows that if the user wishes to drink from the reservoir 22 without having to suck water through the drinking tube 34, the user can turn on the pump 26 using the switch 88. The user can bite down on the bite valve 84, and allow the pump 26 to pump water through the drinking tube 34. If the user wants to spray water from the drinking tube 34, the user the user can turn on the pump 26 using the switch 88. The user can then squeeze the bite valve 84 to open the bite valve 84, and allow the pump 26 to pump water through the drinking tube 34 and out the second end 34B of the drinking tube 34. The flow of liquid through the system in either of these cases is shown in FIG. 11. As shown in FIG. 11, the flow of liquid is initially similar to that shown in FIG. 4 until it reaches the first three inlet connector 70. When the liquid reaches the first three inlet connector 70, it flows into the pump 26 via the inlet 66 and then exits the pump 26 via the outlet 68. The liquid then passes through the second three inlet connector 72 and the third three inlet connector 74, and is directed into the drinking tube 34.

The personal hydration system 20 can be provided in numerous other embodiments, and/or with numerous other optional features.

Figure 12:
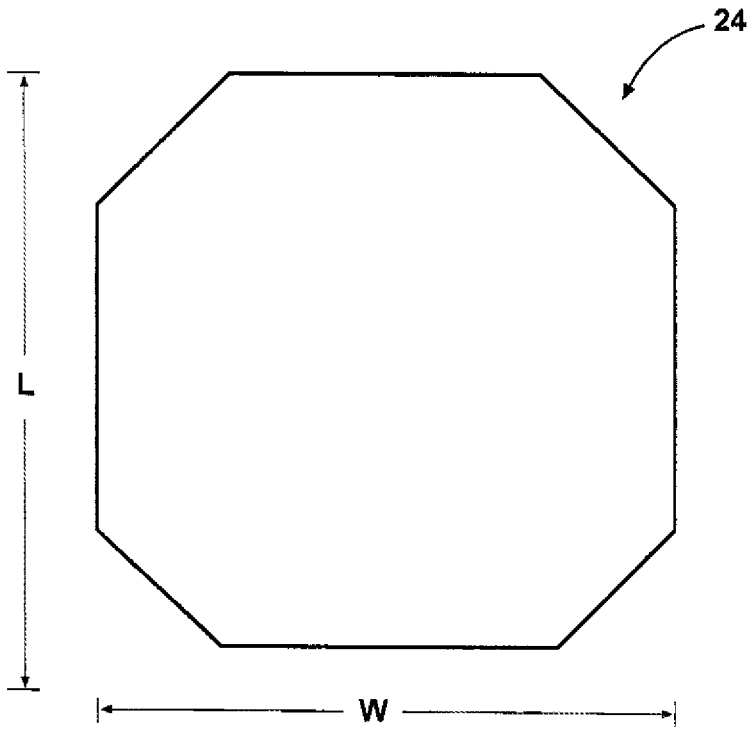
FIG. 12 is a plan view of alternative embodiment of a pad which is shaped to be integrated into a ballistic vest.

In some embodiments, a specially designed pad 24 may be provided. For example as shown in FIG. 12, if the personal hydration system 20 is configured to be worn with a plate carrier, the pad 24 may be a purpose built component that is shaped to match the size and shape of the internal face of a ballistic plate that would typically be positioned adjacent to the wearer's body. As shown in FIG. 12, one embodiment of such a pad 24 has a plan view that is in the configuration of a rectangle with the corners cut off at an angle (that is, mitered) to form an octagonal shape wherein some of the sides having different lengths. While ballistic plates typically only have their top corners mitered, it may be desirable for the cooling pad 24 to have all four corners mitered as shown in FIG. 12. This is because some ballistic vests only allow the ballistic plate to be inserted from the top. Having all four corners of the pad 24 mitered would allow the pad 24 to also be inserted from the top or the bottom and remain in a similar orientation with the plate. In some cases, such a pad 24 may have a length L of about 10 inches and a width W of about 8 inches.

In some embodiments, other pads (for example, a secondary pad, tertiary pad, etc. such as a chest pad) may be added to the personal hydration system 20 shown in the drawings. In order to accommodate such other pads, as shown in FIG. 9, a fifth connector, such as a quick disconnect connector 80E can be provided after the pump outlet 68, and a sixth connector, such as a quick disconnect connector 80F can be provided in the return line 38 to the reservoir 22. Additional conduits can run from these quick disconnect connectors to the inlet and outlet of such a secondary pad.

Figure 13:
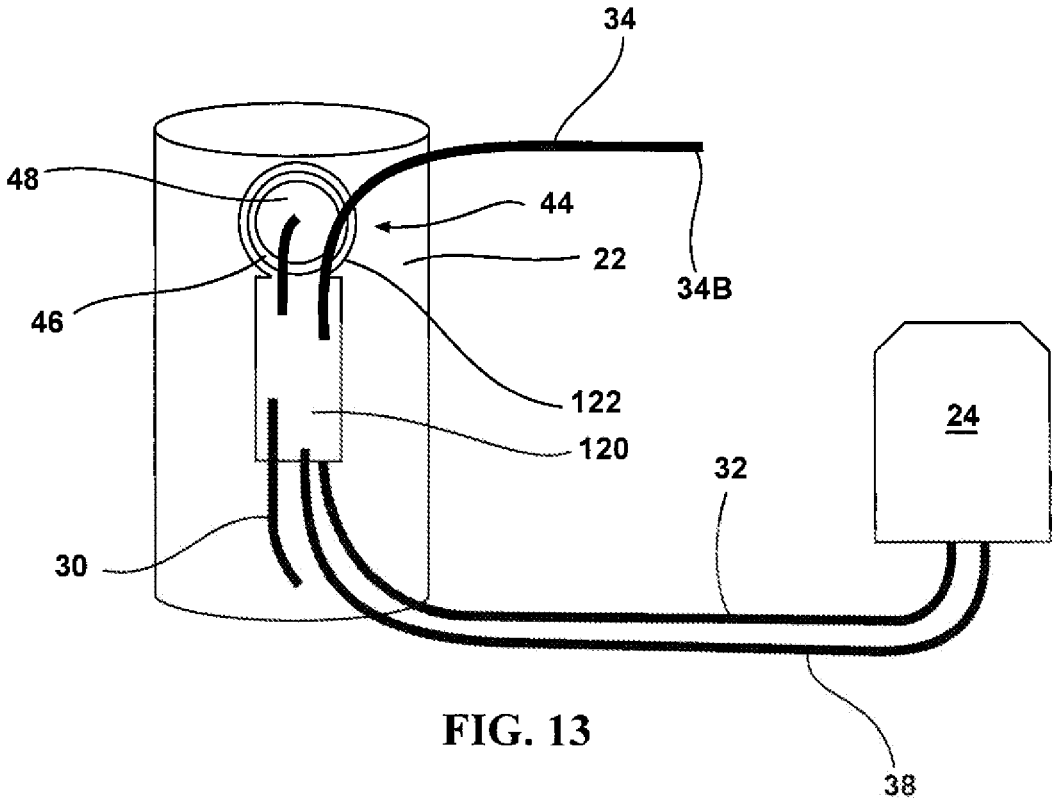
FIG. 13 is a schematic view of a cooling or heating system in which several of the components are contained in a singular manifold that is mounted on the collar around the fill port of the reservoir.
Figure 14:
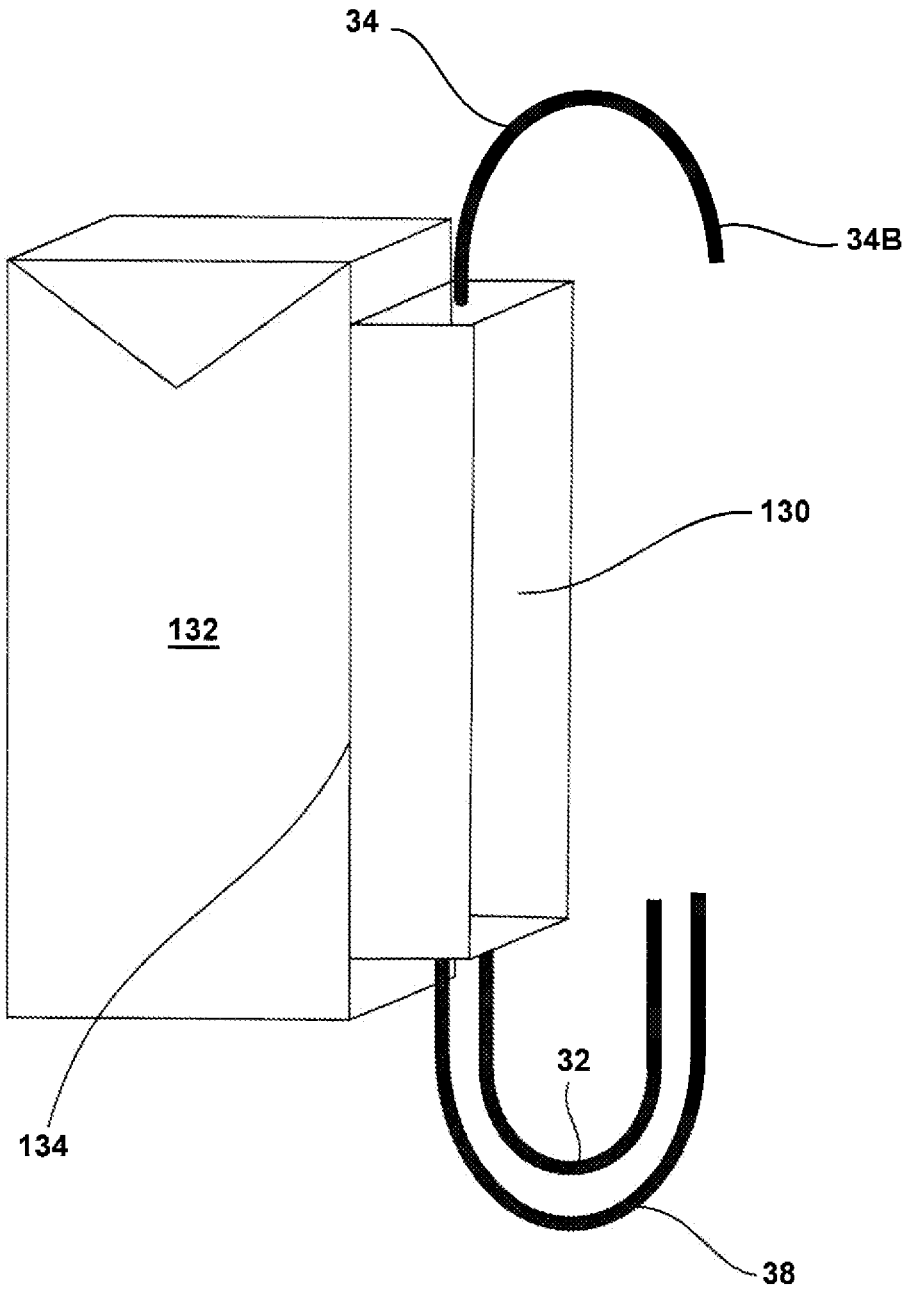
FIG. 14 is a schematic view of an alternative embodiment in which the components are contained in a singular manifold that is joined to a container for the reservoir.

FIGS. 13 and 14 show that in some alternative embodiments, certain components of the personal hydration system 20 can form a single distribution manifold that comprises a stand-alone component, or part of such a component. For instance, certain portions of the conduits, the check valve 86, and/or the pressure relief valve 90 can comprise a single distribution manifold, which together with the pump 26 may be a stand-alone component. The stand-alone component may be positioned in any suitable location including: (1) placed within a receptacle (which may be a container or pouch) for the reservoir (e.g., in a backpack); (2) joined to a receptacle or pouch for the reservoir; or (3) joined to a supporting garment or accessory. The receptacle or pouch for the reservoir 22 can be soft sided, semi-rigid, or rigid. The receptacle or pouch for the reservoir 22 can be insulated. The receptacle or pouch for the reservoir 22 can be joined to a supporting garment via MOLLE webbing. If the distribution manifold or stand-alone component is joined to a supporting garment, it can be attached via MOLLE webbing.

FIG. 13 shows one embodiment of a distribution manifold, which together with the pump 26 and any associated conduit segments may be a stand-alone component or unit 120 that may be mounted on (joined to) the reservoir 22. More specifically, as shown in FIG. 13, such a distribution manifold 120 may comprise a hanger portion 122 that may be mounted on the collar 46 around the fill port 44 of the reservoir 22.

FIG. 14 shows another embodiment of a distribution manifold. In FIG. 14, the distribution manifold and the pump are located in a manifold container 130 that is joined to a container 132 for the reservoir. In this embodiment, the reservoir container 132 may be semi-rigid and insulated, similar to a lunch box. The rear of reservoir container 132 may be connected to a supporting garment (such as a vest) via MOLLE webbing. The manifold container 130 may be joined to the reservoir container 132 at an interface 134 which may be in the form of one or more walls. The interface 134 may have openings or pass-through channels therein that allow the reservoir 22 supply and return conduits 30 and 38 to pass between manifold container 130 and the reservoir container 132.

In some alternative embodiments, a passive pump can be used to transport liquid from the reservoir 22 to the pad 24 and back. A passive pump is a non-electrically powered pumping mechanism that uses the wearer's body movements to pump the liquid through the system, such as between the reservoir 22 and the pad 24. Several examples of passive pumps are described in US Patent Application Pub No. 2019/0367172 A1, Carver, et al. (which provides the U.S. government with rights therein, and which is incorporated by reference herein). The passive pumping mechanisms are shown in FIGS. 14-17 of the Carver, et al. patent application. It should be understood, however, that the personal hydration system 20 of the present invention does not require (and, thus, is free of) a mechanism for circulating air to cool the wearer's body. If a passive pumping mechanism is included, a powered pump may still be needed if it is desired to forcefully squirt water from the drinking tube 34.

The personal hydration system 20 described herein can provide a number of advantages. It should be understood, however, that these advantages need not be required unless they are set forth in the appended claims. The personal hydration system 20 provides a combination of a portable hydration system with a personal cooling or heating system. The personal hydration system 20 eliminates the need for the user to add an additional layer of clothing to provide cooling of the wearer. The personal hydration system 20 provides the ability of the wearer to hydrate by drinking the same liquid that is used as a coolant or heating liquid (as opposed to carrying two different liquids wherein the coolant is a substance that is not suitable for drinking). The personal hydration system 20 eliminates the need for the wearer to carry heavy coolant or packs long after they have reached thermal equilibrium. The personal hydration system 20 provides the ability to forcefully pump liquid out of the reservoir for drinking and/or to fill other containers or irrigate to a wound in a battlefield situation. The liquid transport system 40 can be used with commercially available reservoirs and/or cooling or heating pads. The personal hydration system 20 can be integrated into commercially available ballistic plate carriers, backpacks, etc. The quick connections allow for the reservoir 22 to be removed and refilled, and for the pad to be removed and replaced. The personal hydration system 20 provides multiple functions, yet is not excessively complex, and it is light weight, and low cost in comparison to prior attempts to provide such some of such functions.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A portable personal hydration system with body temperature adjustment capability comprising:

a reservoir for containing a cooling or heating substance;

a pad configured for wearing adjacent to a portion of a wearer's body;

a pump in liquid communication with said reservoir and said pad for generating the flow of a liquid between said reservoir and said pad, said pump comprising an inlet and an outlet;

a plurality of conduits each having a first end portion and a second end portion, wherein said plurality of conduits comprise:

an outflow line extending between the reservoir and the inlet of the pump;

a pad inflow line extending between the outlet of the pump and the pad;

a drinking tube having its first end joined to said pad inflow line at a connection location between the first and second end portions of the pad inflow line, and its second end portion being a free end portion; and a bypass line extending between the outflow line and the drinking tube;

a return line extending between the pad and the reservoir; and a check valve in line with said bypass line, wherein said check valve is arranged to open when suction is applied to the free end portion of the drinking tube so that liquid may by-pass the pump and flow to the free end portion of the drinking tube.

2. The personal hydration system of claim 1 further comprising a pressure relief valve in line with said pad inflow line, wherein said pressure relief valve is located between said connection location and the pad.

3. The personal hydration system of claim 2 wherein the pump, portions of at least some of the conduits including those portions that contain the check valve and the pressure relief valve are provided as a stand-alone unit that is joined to the reservoir.

4. A method comprising:

a) wearing a personal hydration system with temperature adjustment capability, said system comprising:

a reservoir for containing a cooling or heating substance at least some of which is a liquid;

a pad configured for wearing adjacent to a portion of a wearer's body;

a pump configured for generating the flow of liquid between said reservoir and said pad when said pump is activated, said pump having an inlet and an outlet;

a plurality of conduits each having a first end portion and a second end portion, wherein said plurality of conduits comprise:

an outflow line extending between the reservoir and the inlet of the pump;

a pad inflow line extending between the outlet of the pump and the pad;

a drinking tube having its first end joined to said pad inflow line at a connection location between the first and second end portions of the pad inflow line, and its second end portion being a free end portion;

a bypass line extending between the outflow line and the drinking tube; and a return line extending between the pad and the reservoir; and a check valve in line with said bypass line, wherein said check valve is arranged to open when suction is applied to the free end portion of the drinking tube so that liquid may by-pass the pump and flow to the free end portion of the drinking tube; and b) activating said pump to transport liquid from said reservoir to said pad in order to cool or warm the wearer, said pump being activated so that after cooling or warming the wearer, some of said liquid is recirculated from said pad back into said reservoir.

5. The method of claim 4 further comprising:

c) drawing liquid by suction applied to the free end portion of the drinking tube, wherein liquid flows through the by-pass line by-passing the pump and flowing to the free end portion of the drinking tube.

6. The method of claim 4 further comprising:

c) activating said pump in order to pump liquid from said reservoir through a portion of the pad inflow line and then to the free end portion of the drinking tube.

* * * * *